United States Patent [19]

Drozd et al.

[11] Patent Number: 4,844,284

[45] Date of Patent: Jul. 4, 1989

[54] CHILD RESISTANT PACKAGE

[75] Inventors: Edward Drozd, Lake Hiawatha; Michael Lutz, Watchung, both of N.J.

[73] Assignee: Captive Plastics, Inc., Piscataway, N.J.

[21] Appl. No.: 244,756

[22] Filed: Sep. 14, 1988

[51] Int. Cl.[4] ..... B65D 43/04

[52] U.S. Cl. ..... 220/281; 220/347; 206/1.5; 206/540

[58] Field of Search ..... 220/281, 346, 347, 351, 220/350; 206/1.5, 528, 540, 807

[56] References Cited

U.S. PATENT DOCUMENTS

| | | | |
|---|---|---|---|
| 1,676,868 | 7/1928 | Petersen | 220/281 |
| 3,888,350 | 6/1975 | Horvath | 220/347 X |
| 3,942,630 | 3/1976 | Phillips | 206/1.5 |
| 4,113,098 | 9/1978 | Howard | 206/540 |
| 4,174,034 | 11/1979 | Hoo | 206/1.5 |
| 4,561,544 | 12/1985 | Reeve | 206/540 |

*Primary Examiner*—Stephen Marcus
*Assistant Examiner*—Nova Stucker
*Attorney, Agent, or Firm*—Caesar, Rivise, Bernstein, Cohen & Pokotilow, Ltd.

[57] ABSTRACT

A child-resistant package includes a tray with a compartment therein for receiving articles to be packaged, and a cover member slideably received on the tray and movable relative to the tray between opened and closed positions. The cover member is a flexible member having a top wall and peripheral sidewalls. The peripheral sidewalls of the cover member overlie peripheral sidewalls of the tray and latching members on the sidewalls of the cover member and tray cooperate to retain the cover member in a closed position relative to the tray. The latching members are released by applying an inward pressure to the top wall of the cover member, to thereby bias the sidewalls of the cover member outwardly relative to the sidewalls of the tray. An abutment member on the tray prevents such inward deflection of the top wall of the cover member in the event that a child bites down on the package in the forward region thereof. Preferably a peripheral skirt is provided on the tray for overlying lower marginal surfaces of the peripheral walls of the cover member, to thereby prevent a child from wedging his or her teeth between the peripheral walls of the cover member and tray, and thereafter prying the cover member off of the tray.

10 Claims, 2 Drawing Sheets

CHILD RESISTANT PACKAGE

FIELD OF THE INVENTION

This invention relates generally to a child resistant package, and more specifically to a child resistant package which, by following a programmed sequence of steps, easily can be opened by an adult, but which cannot be easily opened by an infant or other young child.

BACKGROUND ART

There are numerous child resistant packages in commercial use and/or disclosed in the patent literature. These packages are commonly employed to package pills, capsules and other medicaments.

For portability a number of child resistant packages have been made in a substantially flat configuration; employing a shallow tray in which the articles to be packaged are stored, and a cover slideably movable on the tray between opened and closed positions.

Prior art constructions employing a sliding arrangement between a tray and cover are disclosed in U.S. Pat. Nos. 1,051,070 (Boye); 2,086,534 (Byrne); 2,295,747 (Mills); 2,777,570 (Mytinger); 3,262,747 (Kotzek et al.); 3,362,564 (Mueller); 3,782,584 (Swenson et al.); 3,888,350 (Horvath); 3,907,103 (Shaw) 3,942,630 (Phillips) 4,076,117 (Wisdom et al.); 4,113,098 (Howard); 4,126,224 (Laauwe et al.); 4,174,034 (Hoo); 4,192,422 (Kotyuk); 4,284,204 (Carey, Jr.); 4,342,403 (Badtke et al.); 4,364,488 (Anjou); 4,401,210 (Anjou) and 4,561,544 (Reeve).

The Kotzek et al. U.S. Pat. No. 3,262,747 discloses an arrangement wherein outwardly directed shelves are associated with the container or drawer, adjacent the bottom wall thereof. While these shelves would appear to at least partially overlie the lower edges of the sidewalls or wings 15 of the closure 14, there is no specific disclosure of such a relationship.

The patents to Shaw, U.S. Pat. No. 3,907,103; Horvath, U.S. Pat. No. 3,888,350; Phillips, U.S. Pat. No. 3,942,630 and Laauwe et al., U.S. Pat. No. 4,126,224 disclose various arrangements wherein pressure is applied to surfaces of a cover for the purpose of releasing cooperative locking members. However, none of these patents disclose an arrangement wherein downward pressure applied to the top wall of a cover causes sidewalls of the cover to bias outwardly for the purpose of releasing cooperating latching members, so that a cover and tray can be slid relative to each other from a closed position to an opened position.

OBJECTS OF THE INVENTION

It is a general object of this invention to provide a child resistant package which is easy to construct and reliable in operation.

It is a more specific object of this invention to provide a child resistant package which can be easily opened by an adult, but yet which is extremely difficult to open by an infant or other young child.

It is a further object of this invention to provide a portable child resistant package of the type employing a tray for storing articles to be retained and a cover slideably movable relative to the tray between opened and closed positions, and wherein the package easily can be opened by an adult but cannot be opened easily by an infant or other young child.

SUMMARY OF THE INVENTION

The above and other objects of this invention are achieved in a child resistant package having a tray in which the articles to be packaged are to be retained, and a cover member slideably received on the tray and movable between opened and closed positions relative to said tray. The tray includes a bottom wall, a rear wall, a front wall and peripheral sidewalls which cooperate to define a compartment in which the articles to be packaged are retained. The cover member is a flexible member having a top wall and peripheral sidewalls, with the top wall covering the compartment when the cover member is in a closed position relative to the tray. The sidewalls of the tray and cover member include cooperating latching members which normally engage each other when the cover member is in a closed position relative to the tray for preventing relative sliding movement between the tray and cover member in a direction to open the package. The sidewalls of the cover member are biased outwardly from the sidewalls of the receptacle by the application of an inward deflecting force to the top wall of the cover member to thereby permit the cooperating latching members to disengage from each other for allowing the cover to be slid relative to the tray into an opened position. An abutment means is provided adjacent the front end of the receptacle for impeding inward deflection of the top wall of the cover in the front region of the package, to thereby make it difficult for an infant or other young child to release the engagement between the latching members and open the package, by biting down on the forward end of the package.

In a preferred embodiment of the invention the abutment member is a vertical rib constituting an integral part of the tray, and most preferably is molded directly to the bottom and front walls of the tray.

In a preferred arrangement the tray includes a peripheral skirt extending transversely beyond the sidewalls of the tray and adjacent the bottom walls of said tray. This skirt is dimensioned to overlie lower margins of the sidewalls of the cover, to thereby prevent the child from wedging his or her teeth between the sidewalls of the cover and the sidewalls of the tray for providing a hinging force on the cover, similar to the force applied to open a book cover, to cause undesired opening of the package.

In a preferred embodiment of this invention serrated or other visually discernible areas are provided on the outer surfaces of the top wall of the cover member and the bottom wall of the tray for the purpose of identifying the regions of the package which should be grasped and squeezed for the purpose of releasing the latching members and for thereafter sliding the cover member relative to the tray to open the package.

BRIEF DESCRIPTION OF THE DRAWINGS

Other objects and many of the attendant advantages of this invention will be readily appreciated as the same become better understood by reference to the following detailed description when considered in connection with the accompanying drawings wherein.

DESCRIPTION OF THE PREFERRED EMBODIMENT OF THE INVENTION

Figure 1:
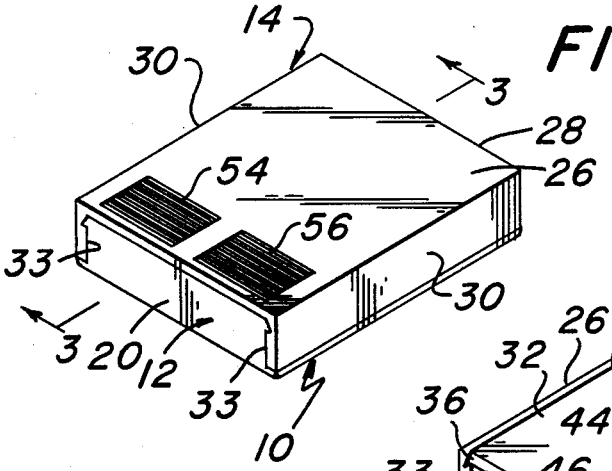
FIG. 1 is an isometric view of the package in a closed condition.

Referring now in greater detail to the various figures of the drawings wherein like reference characters refer to like parts a child resistant package embodying the present invention is generally shown at 10 in FIG. 1. The package 10 basically comprises a rectangular receptacle or tray 12 slideably receiving a cover 14.

Figure 2:
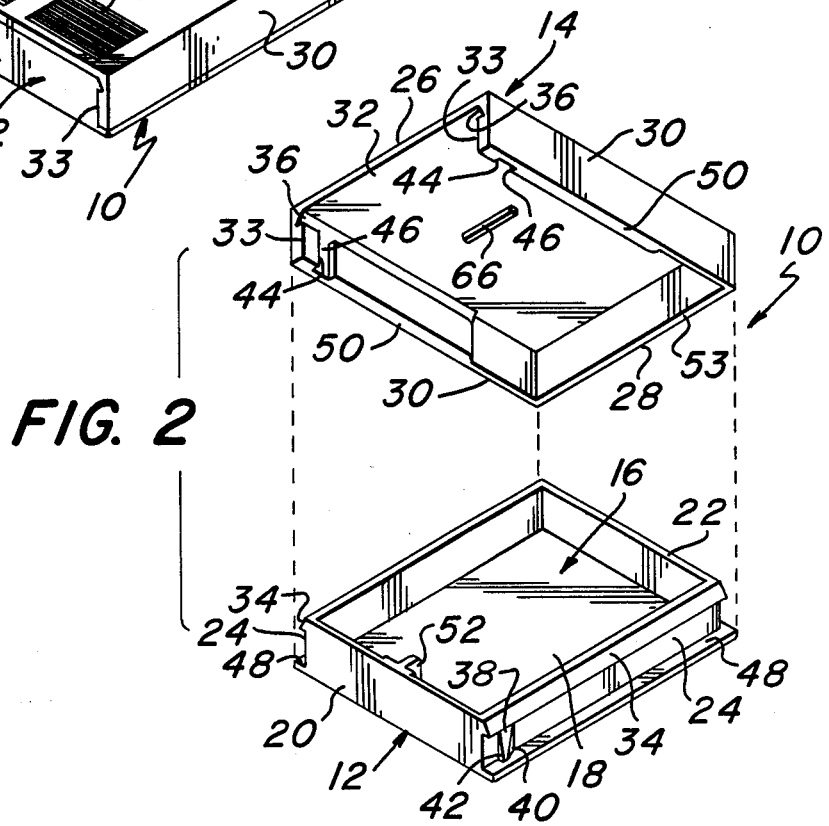
FIG. 2 is an exploded isometric view of the package showing details of construction of the cover and tray thereof.

As can be seen best in FIG. 2, the tray 12 includes an article-retaining compartment 16 defined by a bottom wall 18, a front wall 20, a rear wall 22 and peripheral sidewalls 24. The cover 14 includes a top wall 26, a rear wall 28 and periheral sidewalls 30. The cover 14 has an open front end 32 to permit relative sliding movement between the cover and tray, as will be described in greater detail hereinafter, and this open front end is definded in part by side edges 33 at the forward end of the peripheral sidewalls 30.

Figure 4:
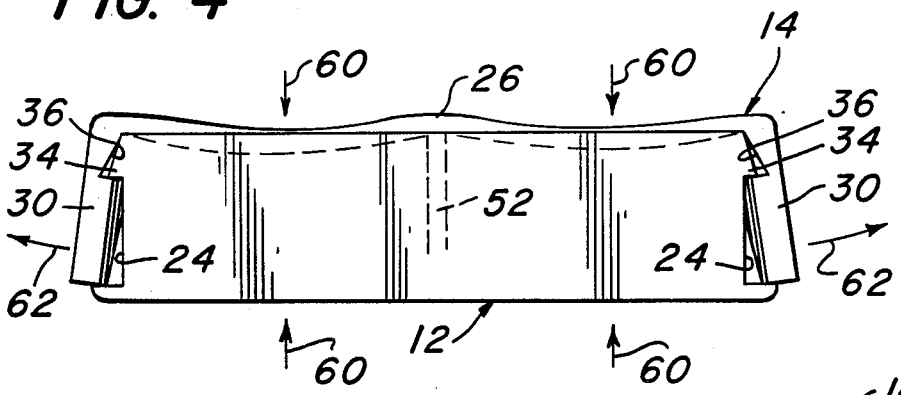
FIG. 4 is an enlarged front elevational view showing the arrangement of elements when the top wall of the cover is deflected for the purpose of opening the package.

As can be seen best in FIGS. 2 and 4, a pair of rails 34 are integrally formed with the sidewalls 24 of the tray, and these rails are received within complimentary shaped recesses or tracks 36 provided on the inner surface of the sidewalls 30 of the cover 14. As a result of this arrangement the tray 12 and cover 14 are slideably movable relative to each other between opened and closed positions.

Figure 6:
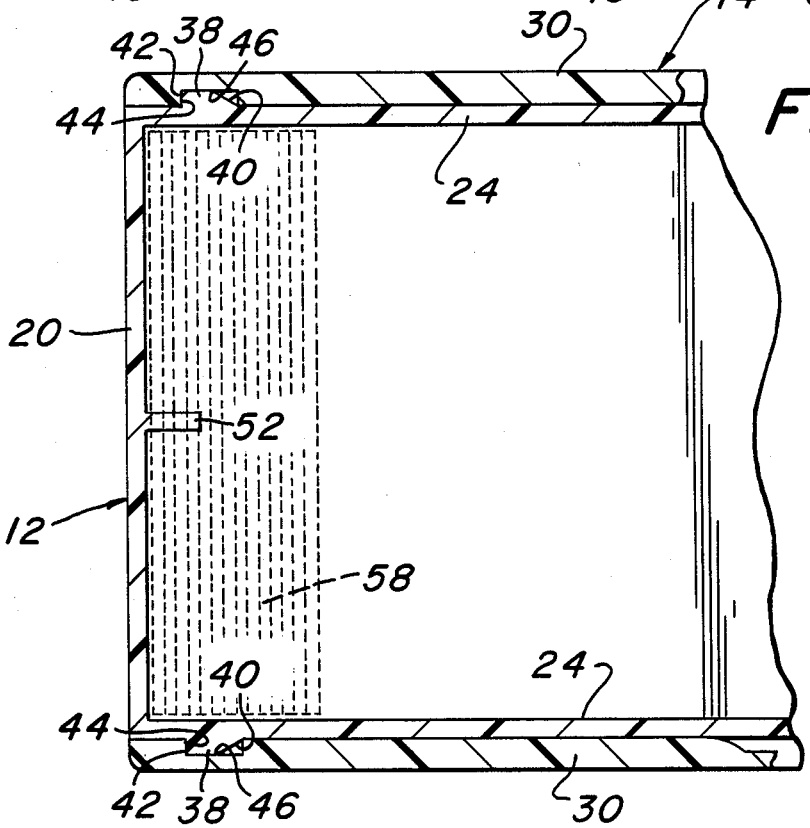
FIG. 6 is an enlarged sectional view taken along line 6—6 of FIG. 3.

Referring to FIGS. 2 and 6, the tray 12 is provided with a pair of projection or latches 38 formed integrally with the sidewalls 24. Each of the projections includes an inclined cam surface 40 which is disposed at an acute angle to the outer surface of the sidewalls 24, and a forwardly locking or latching surface 42 disposed substantially normal to the outer surface of the sidewall.

Still referring to FIGS. 2 and 6, a pair of rearwardly facing locking or latching surfaces 44 are provided on the sidewalls 30 of the cover 14 for engaging the forwardly facing locking or latching surfaces 42 on the tray 12 to lock the package in a closed condition. It should be noted that each of the locking surfaces 44 is provided on one side of a recess 46 which, when the package is closed, receives a corresponding projection 38 therein (FIG. 6).

Figure 5:
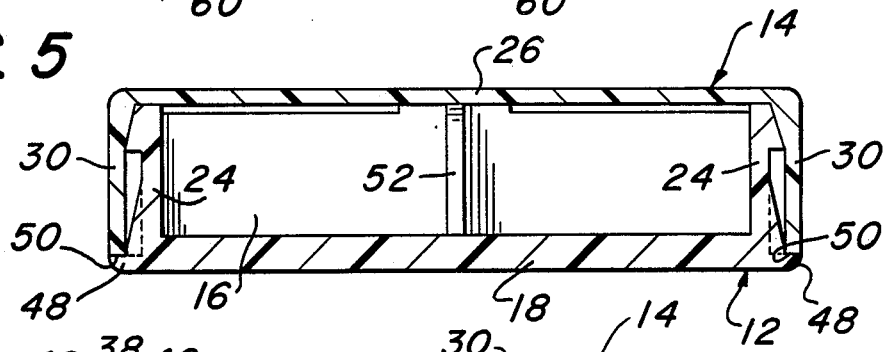
FIG. 5 is an enlarged sectional view taken along 5—5 of FIG. 3.

Referring to FIGS. 2 and 5, the tray 12 includes a pair of peripheral skirts 48 extending transversely beyond the sidewalls 24 adjacent the bottom wall 18. These peripheral skirts 48 are dimensioned to completely overlie lower surfaces 50 of the peripheral sidewalls 30 of the cover 14, to thereby prevent a child from wedging his or her teeth between the sidewalls of the cover and tray, and prying the cover off of the tray, in a manner similar to the opening of a book.

Figure 3:
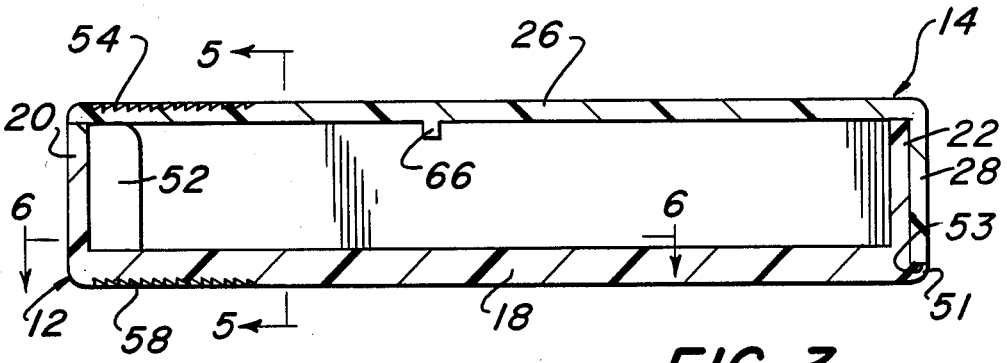
FIG. 3 is an enlarged sectional view taken along line 3—3 of FIG. 1.

As can be seen best in FIG. 3, a rear peripheral skirt 51 of the tray 12 overlies the lower marginal surface 53 of the cover rear wall 28 to provide further assurance that a child will not wedge his or her teeth between the rear walls of the cover and receptacle, and thereafter pry the cover off the receptacle.

Referring to FIGS. 2, 3 and 6, an extremely important feature of this invention resides in the provision of an abutment means 52, preferably in the form of a vertical rib integrally molded with the tray 12 in the inside compartment 16 of said tray. This rib 52 is positioned adjacent the front wall 20, and, in the preferred embodiment, is integrally molded to the front wall 20 and the bottom wall 18 of the tray substantially midway between the tray sidewalls 24. The purpose of this abutment is to help prevent inward flexing of the top wall 26 of the cover 14, in the event that a child places the front of the package in his or her mouth, and then bites down on it.

As will be explained hereinafter, it is the downward deflection of the top wall 26 of the cover 14 that is responsible for releasing the engagement between the rearwardly facing locking surfaces 44 provided on the sidewalls 30 of the cover 14, and the forwardly facing locking surfaces 42 forming a part of the projections 38 on the tray 12. Moreover, this downward deflection is most easily achieved adjacent the front of the package, due to the fact that the cover 14 is provided with an open front end 32, and therefore does not include a front peripheral wall tying the two peripheral sidewalls 30 together. As will be explained in greater detail hereinafter, downward or inward deflection of the top wall 26 of cover 14, at the forward region thereof, causes the peripheral sidewalls 30 to flex outwardly, thereby permitting disengagment between the rearwardly facing locking surfaces 44 of the cover and the forwardly facing locking surfaces 42 of the tray to permit relative sliding movement between the cover and tray into an opened condition.

Referring specifically to FIGS. 1, 3 and 6, the package 10 of this invention is provided with visually perceivable areas which preferably are to be engaged for the purpose of providing the programmed steps required to open the package 10. In the most preferred embodiment of this invention the visually perceivable areas include a pair of transversely spaced-apart ribbed or serrated areas 54 and 56 on the outer surface of top wall 26 of the cover 14 on opposite sides of the rib 52, and a continuous, transversely extending ribbed or serrated band 58 on the outer surface of the bottom wall 18 of tray 12, and extending for substantially the full transverse extent of said bottom wall 18. As can be seen best in FIG. 3 the transversely spaced-apart serrated areas 54 and 56 are in vertical alignment with the continuously transversely extending serrated area 58.

The technique for both opening and closing the package 10 will now be described; it being understood that specific instructions can be provided directly on the package or on suitable instructional material accompanying the package.

In accordance with the preferred technique for opening the package a person holds the package 10 in both hands, with his or her thumbs on the spaced-apart serrated areas 54, 56 of the cover 14, and with the front wall 20 of the receptacle being nearest the person's body. The index fingers of both hands are placed on the serrated area or band 58 on the bottom wall 18 of the tray 12, and the person simultaneously squeezes his or her thumb and index fingers together, in the direction illustrated by arrows 60 shown in FIG. 4. This inward compressive force, being located on opposite sides of the vertical rib 52, causes an inward deflection of the top wall 26 of the cover 14 in the regions located between the vertical rib 52 and the spaced-apart sidewalls 24 of the tray 12, as can be seen best in FIG. 4. This inward deflection of the top wall causes sidewalls 30 of the cover to flex outwardly, as is illustrated by arrows 62, to substantially release the engagement between the rearwardly facing locking surfaces 44 of the cover with the forwardly facing locking surfaces 42 on the projections 38 forming part of the tray. At this time the thumb and index fingers of the person can be slid relatively to each other to thereby slide the cover 14 relative to the tray 12 to open the package 10.

To close the package 10, after the desired contents of the tray 12 has been removed, the cover 14 is slid in a closing direction by preferable pushing the cover 14 on the rear wall 28 thereof. This causes the forward side edges 33 on the sidewalls 30 of the cover to ride over the cam surfaces 40 on the projections 38, causing the sidewalls 30 of the cover to expand outwardly, and thereafter retract when the projections 38 of the tray align with the recessess 46 in the sidewalls of the cover, as is shown best in FIG. 6. This positively locks the cover to the tray in a closed condition; preventing the inadvertant opening of the package by a child.

Referring to FIGS. 2 and 3, it should be noted that a rib 66 is integrally molded as a part of the top wall 26 of the cover 14, and extends into the article retaining compartment 16. This rib functions to limit rearward movment of the cover 14 relative to the tray 12, by abutting against the rear wall 22 of said tray when the cover 14 is moved into an opened position relative to the receptacle 12.

Without further elaboration the foregoing will so fully illustrate my invention that others may, by applying current or future knowledge, adopt the same for use under various conditions of service.

What is claimed as the invention is:

1. A child-resistant package including:

a tray having a bottom wall and peripheral rear, front and sidewalls defining a compartment for receiving articles to be packaged;

a cover member slideably retained on said tray and movable between an opened and closed position relative to said tray, said cover member being a flexible member having a top wall and peripheral sidewalls and said top wall overlying and covering the compartment when the cover member is in a closed position relative to said tray;

said sidewalls of said tray and of said cover member including cooperating latching members normally engaging each other when the cover member is in a closed position relative to said tray for preventing relative sliding movement between said tray and cover member to an opened position;

said sidewalls of the cover member being biased outwardly from the sidewalls of the tray by inwardly deflecting the top wall of the cover member to thereby permit the cooperating latching members to disengage from each other to permit the cover member to be slid relative to the tray into an opened position; and abutment means adjacent a front end of the tray for impeding inward deflection of the top wall of the cover member adjacent the front wall of the tray to thereby make it difficult for an infant to release the latching members and open the package by biting down on said package at the front end thereof.

2. The child-resistant package of claim 1 wherein the abutment means is a rib integrally molded as part of the tray in the inner compartment thereof.

3. The child-resistant package of claim 2 wherein said abutment means is a rib integrally molded to the front and bottom walls of said tray.

4. The child-resistant package of claim 2 wherein said abutment means is located substantially midway between the peripheral sidewalls of the tray.

5. The child-resistant package of claim 1 wherein the tray includes a peripheral skirt extending transversely beyond each of the sidewalls of said tray adjacent the bottom wall of said tray, said sidewalls of the cover member having lower marginal edges overlying and closely adjacent the peripheral skirts for preventing a child from wedging his or her teeth between the sidewalls of the cover member and the sidewalls of the tray and thereafter prying the cover member off of said tray.

6. The child-resistant package of claim 5 wherein said cover member includes a peripheral rear wall joined to the sidewalls of said cover, said tray including a peripheral skirt extending rearwardly from the rear wall of said tray adjacent the bottom wall of said tray for overlying a lower marginal edge of the rear wall of the cover member.

7. The child-resistant package of claim 1 including visually discernible areas on the outer surfaces of the top wall of the cover member and the bottom wall of the tray, said areas being engageable for the purpose of sliding the cover member relative to said tray into an opened position.

8. The child-resistant package of claim 7 wherein said visually discernible areas include serrations or ribs on the outer surface of the top wall of the cover member and on the outer surface on the bottom wall of the tray.

9. The child-resistant package of claim 8 wherein a pair of serrated or ribbed areas are provided on the outer surface of the top wall of the cover member, said pair of serrated areas being located on opposite transverse sides of the abutment means.

10. The child-resistant package of claim 9 wherein said abutment means is a rib integrally molded as part of the tray to the inner compartment thereof and being disposed substantially midway between the peripheral sidewalls of the tray.

* * * * *